United States Patent [19]

Gist et al.

[11] Patent Number: 4,602,893

[45] Date of Patent: Jul. 29, 1986

[54] RING GASKET INSTALLATION TOOL

[75] Inventors: Tun C. Gist, Jennings, La.; Arthur G. Ahlstone, Ventura, Calif.

[73] Assignee: Shell Offshore Inc., Houston, Tex.

[21] Appl. No.: 703,015

[22] Filed: Feb. 19, 1985

[51] Int. Cl.[4] ..... B63C 11/00

[52] U.S. Cl. ..... 405/185; 405/191; 166/338; 166/340; 29/235; 29/451

[58] Field of Search ..... 405/188, 190, 191, 195, 405/169, 185; 166/338, 340; 277/1, 9, 9.5; 251/1 R, 1 A, 1 B; 29/235, 451

[56] References Cited

U.S. PATENT DOCUMENTS

| | | | |
|---|---|---|---|
| 3,350,103 | 10/1967 | Ahlstone | 277/9 |
| 3,463,226 | 8/1969 | Johnson | 405/191 |
| 4,386,659 | 6/1983 | Shotbolt | 405/169 |
| 4,417,830 | 11/1983 | Shotbolt | 405/195 |
| 4,478,586 | 10/1984 | Gentry et al. | 405/195 |
| 4,515,376 | 5/1985 | Okamuro | 277/9.5 |

FOREIGN PATENT DOCUMENTS

| | | | |
|---|---|---|---|
| 2065065 | 6/1981 | United Kingdom | 405/191 |

*Primary Examiner*—Cornelius J. Husar
*Assistant Examiner*—Kristina I. Hall

[57] ABSTRACT

A method and apparatus are described for the installation and removal of a ring gasket from an underwater wellhead connection. The ring gasket is carried by a ring gasket installation tool from the surface to the underwater wellhead connection by a self-propelled underwater vehicle. Final placement of the ring gasket may be accomplished by selective manipulation of the ring gasket installation tool by the underwater vehicle or by a cable attached to the tool.

17 Claims, 10 Drawing Figures

FIG.1A
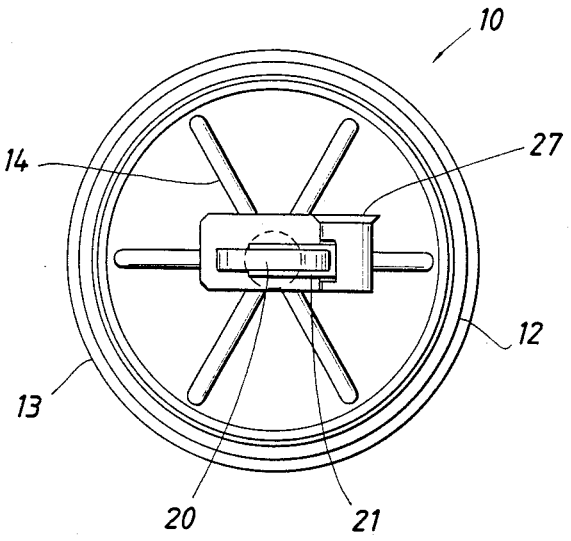
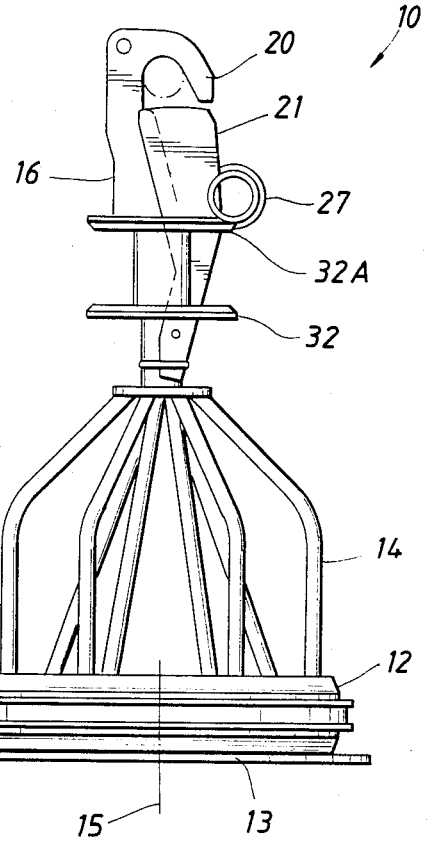
FIG.1B
FIG.1C
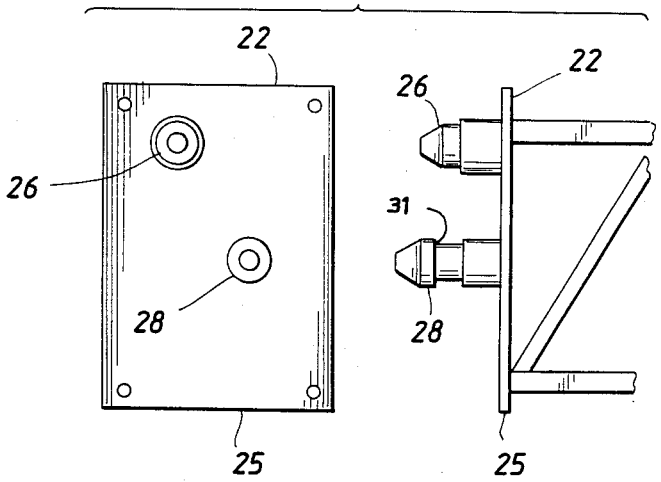

RING GASKET INSTALLATION TOOL

BACKGROUND OF THE INVENTION

1. Field of the Invention

The present invention relates to an apparatus for use in replacing a ring gasket carried by a subsea wellhead connector.

2. Description of the Prior Art

In the drilling of oil and gas wells at an underwater site, a coupling is used for connecting subsea wellhead components to one another in sealed or pressure-tight relation. It is usual for the upper portion of the coupling to contain a seal or ring gasket retained in place by a suitable device, this ring gasket being brought into sealing relation with a lower device previously-installed at the underwater location. The ring gasket used in the coupling may commonly be designated as a "RX", "CX", "AX" or "VX" ring gasket depending upon the manufacturer of the gasket.

When the underwater coupling is disconnected, it is desirable to replace the previously-installed ring gasket with a new one to insure a pressure-tight fit upon reengagement of the coupling assembly. It is also desirable to inspect the surface of the old gasket for unusual deformations that would indicate damage to the sealing shoulders which mate with the gasket. After the underwater coupling is disconnected, the entire upper portion of the wellhead connector coupling with its attached ring gasket may be retrieved to the deck of surface vessel conducting the well operations. In shallow water depths, the retrieval operation does not cause an unnecessary amount of downtime. The ring gasket is usually removed from a ring gasket retainer assembly, such as the one disclosed in U.S. Pat. No. 3,350,103, entitled "Seal Ring Holding Device", issued Oct. 31, 1967 to A. G. Ahlstone, by disengagement of a split ring normally held in position about the ring gasket by a series of spring-loaded circumferentially spaced plungers.

In deeper waters, to retrieve the ring gasket retainer assembly to the surface would require considerable time and entail an expense of approximately one million dollars due to the retrieval of the coupling to the surface along with thousands of feet of pipe to which it is connected.

Accordingly, it is desirable to present a method and apparatus for installing a new ring gasket into a subsea coupling, without having to retrieve the coupling to the surface. It is also desirable to retrieve the previously installed ring gasket for inspection, and from a depth generally below that at which a diver can operate, say, 5000 feet or more.

SUMMARY OF THE INVENTION

The apparatus of the present invention comprises a ring gasket installation tool that carries a new ring gasket from the ocean surface to the disconnected subsea coupling near the ocean floor. The ring gasket installation tool may also carry the previously-installed ring gasket back to the surface. In this manner, the coupling that carries the previously-used ring gasket does not have to be retrieved to the surface along with the thousands of feet of pipe above it.

The tool is carried by a subsea transportation assembly which may consist of various combinations of equipment capable of underwater movement, propulsion and/or manipulation such as a selfpropelled underwater vehicle with manipulator arms, controlled from a surface location, or a cable depending downwardly from the surface.

The tool carries the ring gasket by having a central body section insertable up through the opening defined through the ring gasket, and an outwardly-extending shoulder formed near the lower end of the central body section that prevents the ring gasket from dropping off the tool. The tool may be attached to various portions of the subsea transportation assembly by attachment devices such as hooks, latches, and/or cables.

It is an object of the present invention to provide a device which can install a new ring gasket into a coupling underwater.

It is a further object of the present invention to provide a device which can retrieve a previously-installed ring gasket from the coupling to the surface.

These and other features, objects, and advantages of the present invention will become apparent from the following detailed description, wherein reference is made to the figures in the accompanying drawing.

BRIEF DESCRIPTION OF THE DRAWINGS

FIGS. 1A and 1B are front and top views respectively of one form of the ring gasket installation tool. FIG. 1C is a front and side view of a storage plate that may carry the tool.

DESCRIPTION OF THE PREFERRED EMBODIMENT

Figure 3:
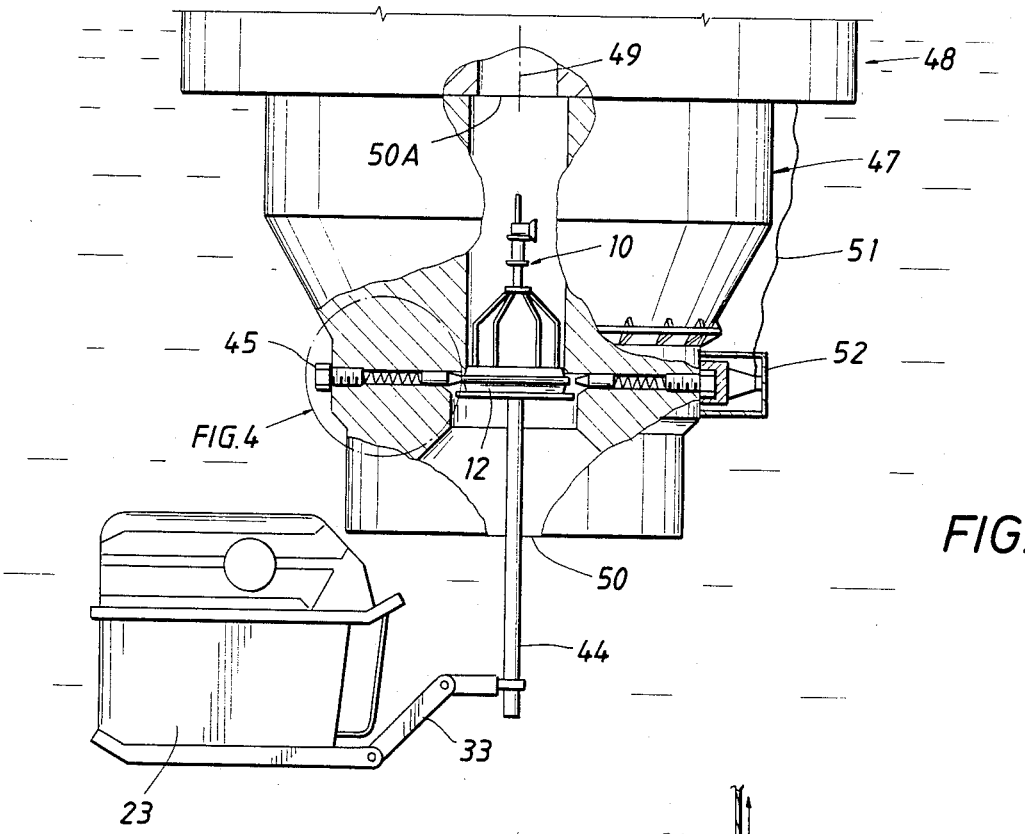
FIG. 3 is a schematic representation of the tool being inserted upwardly to place the ring gasket between the ring gasket retainer assembly.

A ring gasket installation tool 10 is shown in FIG. 1A and 1B. In the preferred embodiment, the tool 10 consists of a centralizer body means 11, which is shown inserted upwardly through a ring gasket 12, the lower portion of the centralizer body means 11 forming a shoulder portion means 13 which prevents the ring gasket 12 from further downward movement over the centralizer portion 14 of the centralizer body means 11. Both portions 13, 14 have a common central vertical axis 15. The centralizer portion 14 has an outer diameter less than the inner diameter of the ring gasket 12, to prevent the ring gasket 12 from substantial lateral movement toward and away from the central vertical axis 15. The shoulder portion means 13 has an outer diameter greater than the inner diameter of the ring gasket 12, in order to form a barrier to prevent downward vertical movement of the ring gasket 12 below the shoulder portion means 13. The shoulder portion's 13 outer diameter is less than the inner diameter of an opening 50 defined upwardly through a wellhead connector 47 (FIG. 3).

The ring gasket 12 has a groove defined circumferentially about its outer surface to allow the ring gasket retainer assembly 45 (FIGS. 3 & 4) to contact and retain the ring gasket 12 at a desired location.

More specifically, the centralizer portion 14 and the shoulder portion means 13 have a longitudinal axis coaxial with the axis of a surface of revolution that envelopes the outer surface of both portions 13, 14 of the centralizer body means 11. The outer surface of the surface of revolution of the centralizer portion 14 defines an outer diameter less than the inner diameter of the ring gasket 12. The outer surface of the surface of revolution of the shoulder portion means 13 defines an outer diameter greater than the inner diameter of the ring gasket 12.

In the preferred embodiment the centralizer portion 14 of the centralizer body means 11 is shown to be formed in a cage structure in order to support the ring gasket 12. It is recognized that many other geometric configurations may be used to accomplished the same mechanical results.

The centralizer body means 11 which carries the ring gasket 12 may also incorporate or be formed from buoyant material means 18 (shown in FIG. 7) in order to supply an effective positive buoyancy to the ring gasket installation tool 10. Eccofloat TG-28A foam material may be used to supply this upper buoyancy, having an average density of 29 lbs. per cubic foot. This material is available from Emerson and Cumming Inc., located at 869 Washington St., Canton, Mass., 02021.

Figure 2:
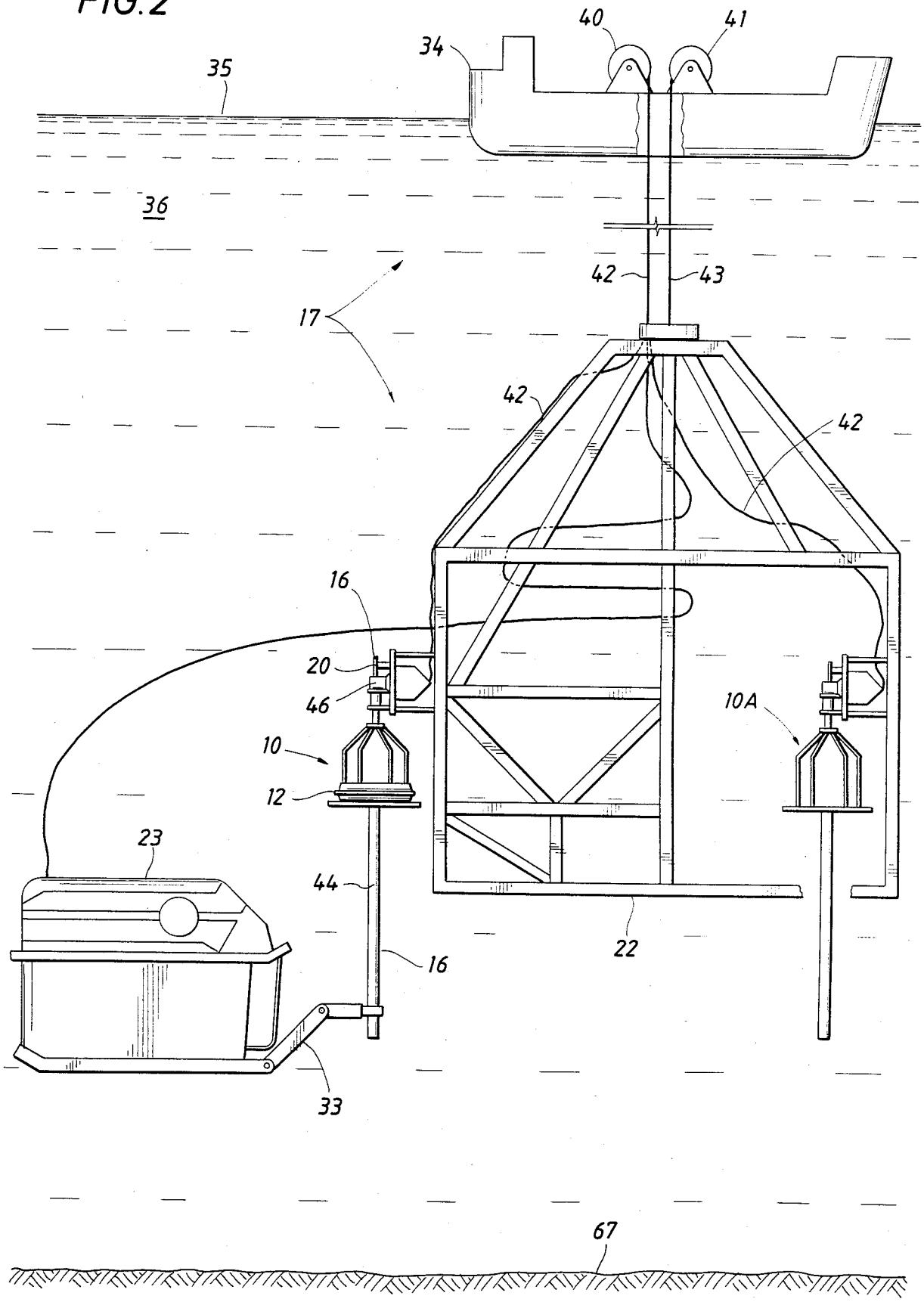
FIG. 2 is a schematic representation showing the tool simultaneously attached to the cage portion and underwater vehicle portion of a subsea transportation assembly.

As shown in FIG. 1B & 1C attachment means 16 is attachable to a storage plate 25 carried by the cage portion 22 of a subsea transportation assembly 17 (FIG. 2). The hook 20 attaches to Pin 26 carried by the storage plate 25 whereas an alignment funnel 27 is insertable over Pin 28. A latch 21 is engageable with shoulders 31 to prevent the ring gasket installation tool 10 from falling from the storage plate 25. Manipulator arm guides 32 and 32A are formed about the lower elements of the latch 21. The guides 32 and 32A assist in alignment of a manipulator arm 33 carried by an underwater vehicle 23 (FIG. 2) with the latch 21. The installation tool 10 may therefore be moved from the storage plate 25 to another location by the underwater vehicle 23. The manipulator arm 33 may take the form of a device such as that described in U.S. Pat. No. 3,463,226 entitled "Underwater Wellhead Apparatus" issued Aug. 26, 1969 to G. D. Johnson.

As shown in FIG. 2, a vessel 34 is floating upon a surface 35 of a body of water 36. The vessel 34 carries a winch 40 which has unreeled a power and/or signal transmission cable 42 downwardly through said body of water 36 to the underwater vehicle 23. A second winch 41 has lowered a weight-supporting cable 43 which carries the cage portion 22 of the subsea transportation assembly 17 in the body of water 36. It is to be understood that the cables 42 and 43 may be combined into a single cable and lowered by means of a single winch. The underwater vehicle 23 may be carried downwardly through a portion of the body of water 36 while being located within a storage cage portion 22 of assembly 17. Once the underwater vehicle 23 and cage 22 reach the desired operating depth, the vehicle 23 may swim outside of the cage portion 22 in order to transport the installation tool 10 to its desired location.

The vessel 34, cables 42, 43, cage 22, underwater vehicle 23, and cables 24, 24A (FIG. 5) all form portions of a subsea ring gasket transportation assembly 17. The assembly 17 consists of all equipment required to move the ring gasket installation tool 10 from the surface 35 of the body of water 36 to a desired location beneath the surface 35.

The underwater vehicle 23 may carry the installation tool 10 downwardly during the entire journey to the desired location, or as shown in FIG. 2, the tool 10 may have been carried downwardly by the cage portion 22. Once at the desired depth, the underwater vehicle 23 swims from the cage portion 22 to a location beneath the installation tool 10. The subsea transportation assembly 17 attachment means 16, which secures the tool 10 to a selected portion of the subsea transportation assembly 17, consists in this configuration of a hook 20 connected to the cage portion 22 of the subsea transportation assembly 17, and a rod 44 connected to the lower portion of the tool 10 which extends downwardly a selective distance below the installation tool 10. This rod 44 is operatively engageable with the manipulator arm 33 carried by the underwater vehicle 23. The rod's 44 selective length is sufficient to allow insertion of the ring gasket 12 carried by the tool 10 upward through an opening 50 defined through the wellhead connector 47 (FIG. 3) to a ring gasket retainer assembly 45 (FIG. 3). A latch release 46 may be actuated by a signal through the signal transmission cable 42 to disengage the attachment means 16 from the cage portion 22 of the subsea transportation assembly 17. In this manner the underwater vehicle 23 may move the installation tool 10 from the cage portion 22 to a desired location beneath the wellhead connector 45 (FIG. 3).

It should be understood that a plurality of tools 10, 10A may be transported simultaneously by the transportation assembly 17. Another tool 10A is shown for example carried by the cage portion 11, that does not carry a ring gasket 12 to the submerged location. Tool 10A may be used to return a used ring gasket 12 to the surface 35 for visual inspection.

As shown in FIG. 3 a wellhead connector 47 is carried at the lower end of a pipe assembly 48 such as a riser, well known to the art. Both wellhead connector 47 and pipe assembly 48 have a central vertical axis 49 which define the longitudinal axis of openings 50 and 50A defined upwardly through the wellhead connector 47 and pipe assembly 48. A hydraulic power line 51 supplies hydraulic fluid (not shown) to a hydraulic actuator or driver 52 positioned to actuate the ring gasket retainer assembly 45 when the gasket 12 is held in position between elements of the retainer assembly 45.

The underwater vehicle 23 has inserted the rod 44 upwards through the opening 50 in order to position the gasket 12 at the correct elevation between elements of the ring gasket retainer assembly 45.

Figure 4:
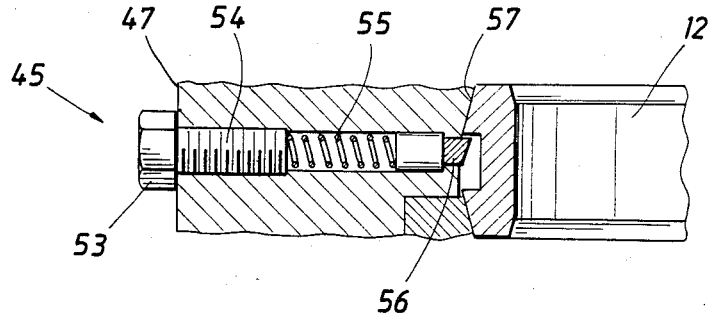
FIG. 4 is a schematic representation of the ring gasket retainer assembly.

As shown in FIG. 4 the retainer assembly 45 may consist of the following elements as set forth in the "Seal Ring Holding Device", U.S. Pat. No. 3,350,103 mentioned earlier. When turned, a hex head 53 attached to a screw 54 drives helical spring 55 which contacts a segment of a retainer ring 56. The retainer ring 56 shown in cross section is annular in nature and forms a retaining mechanism to retain the ring gasket 12 in position, to allow the gasket 12 to contact with a landing shoulder 57 formed by a portion of the wellhead connector 47. Actuation of the hexhead 53 by a wrench socket in the manipulator arm 33 of the underwater vehicle 23, or a hydraulic driver 52, as described in U.S. Pat. No. 3,463,226 issued Aug. 26, 1969 to G. D. Johnson will allow the ring gasket 12 to be held in locked position adjacent the landing shoulder 57.

Conversely, prior to installing a new ring gasket 12, the old ring gasket 12 may be allowed to fall away from the landing shoulder 57 and drop down through the opening 50 (FIG. 3) to the ocean floor 67 if the hexhead 53 is actuated in a direction to cause the retainer ring 56 to withdraw away from the outer diameter of the ring gasket 12.

Figure 5:
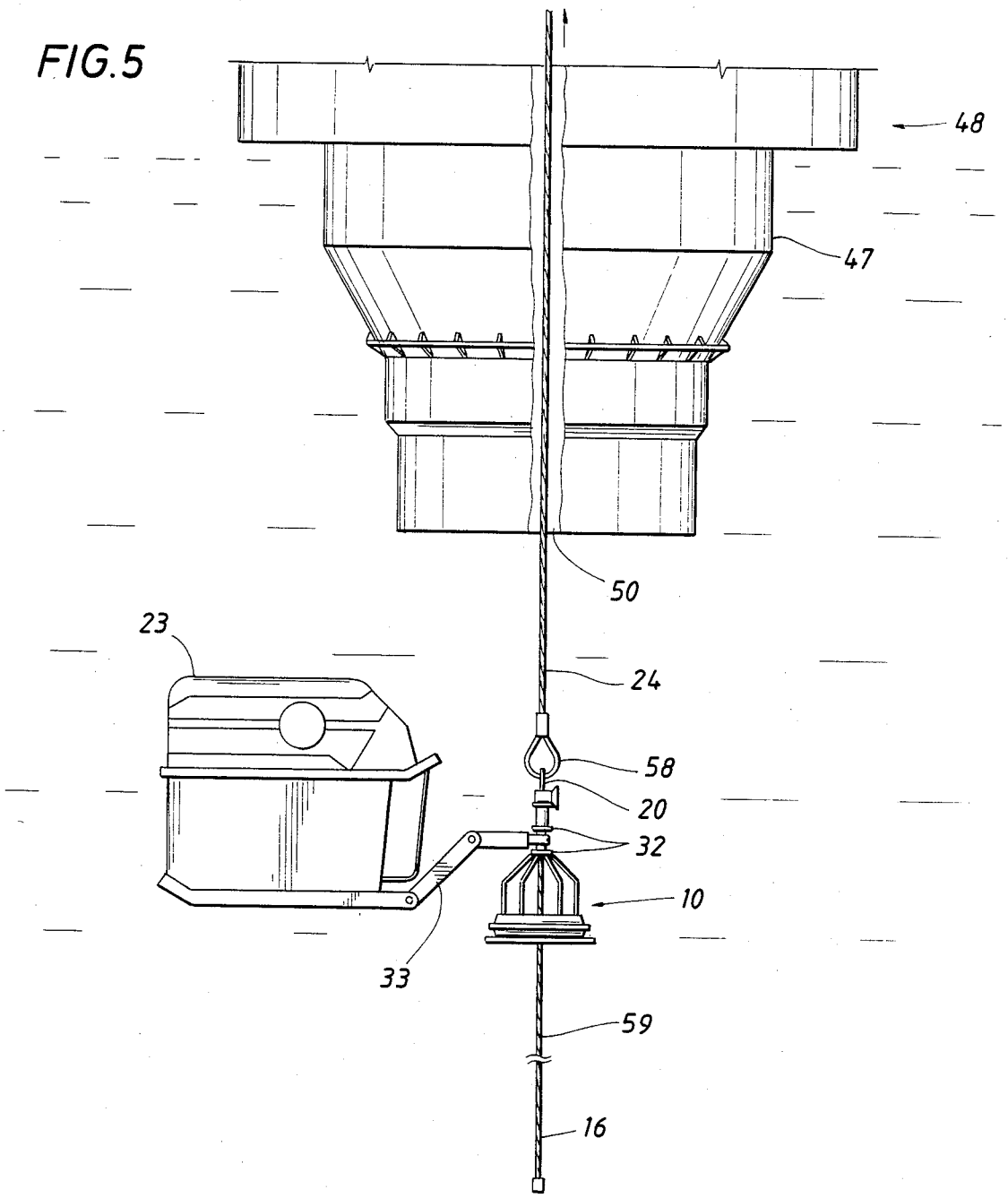
FIG. 5 is a schematic representation of the tool attached to a cable portion of the subsea transportation assembly.

As shown in FIG. 5, the underwater vehicle 23 has positioned the end of manipulator arm 33 between the manipulator arm guides 32 and 32A. This has allowed the latch 21 (FIG. 1) to swing clear of the hook 20 and allows the hook 20 to be connected over a ring 58 carried at the lower end of the subsea transportation assembly cable portion 24 and lowerable through openings 50, 50A (FIG. 3). The underwater vehicle 23 may now be disengaged from the ring gasket installation tool 10. The cable portion 24 can now be moved upwardly through the opening 50 from a winch above the surface 35 of the body of water 36. A portion of the subsea transportation assembly attachment means 16, in the form of a cable 59, is shown depending downwardly from the lower portion of the centralizer body means 11 of the tool 10.

Figure 6:
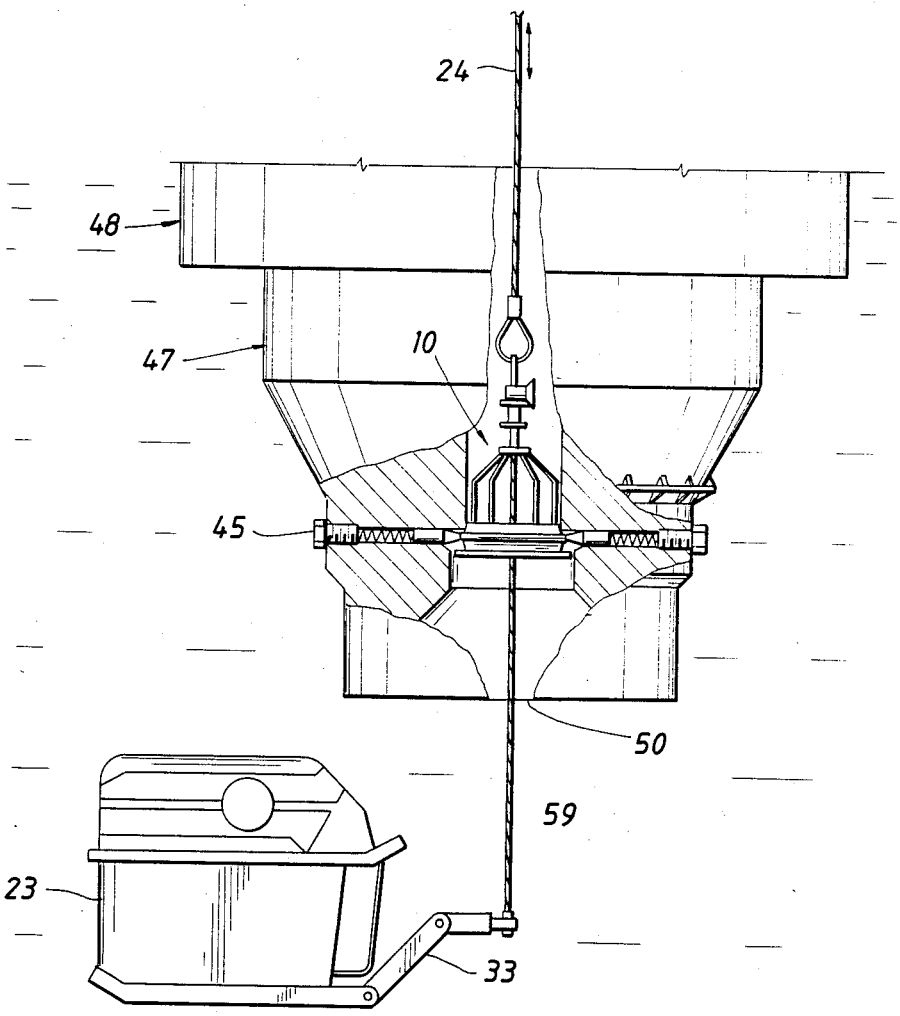
FIG. 6 is a schematic representation of the tool positioning the ring gasket in the ring gasket retainer assembly.

As shown in FIG. 6, the cable 59 has been operatively engaged by manipulator arm 33 carried by the underwater vehicle 23. The underwater vehicle 23 may apply a downward force to the lower end of the cable 59 in order to aid in the proper positioning of the tool 10 in relation to the ring gasket retainer assembly 45, as the cable portion 24 of the subsea transportation assembly 17 is moved upward and downward through the wellhead connector 47. In this manner a downward force applied by the underwater vehicle 23 may be used to tension the cable portion 24 in order to alleviate slack in the cable portion 24 due to vessel 34 movement, the cable portion 24 being operatively driven by winch equipment (not shown) carried in this case by the surface vessel 34 (FIG. 2).

Figure 7:
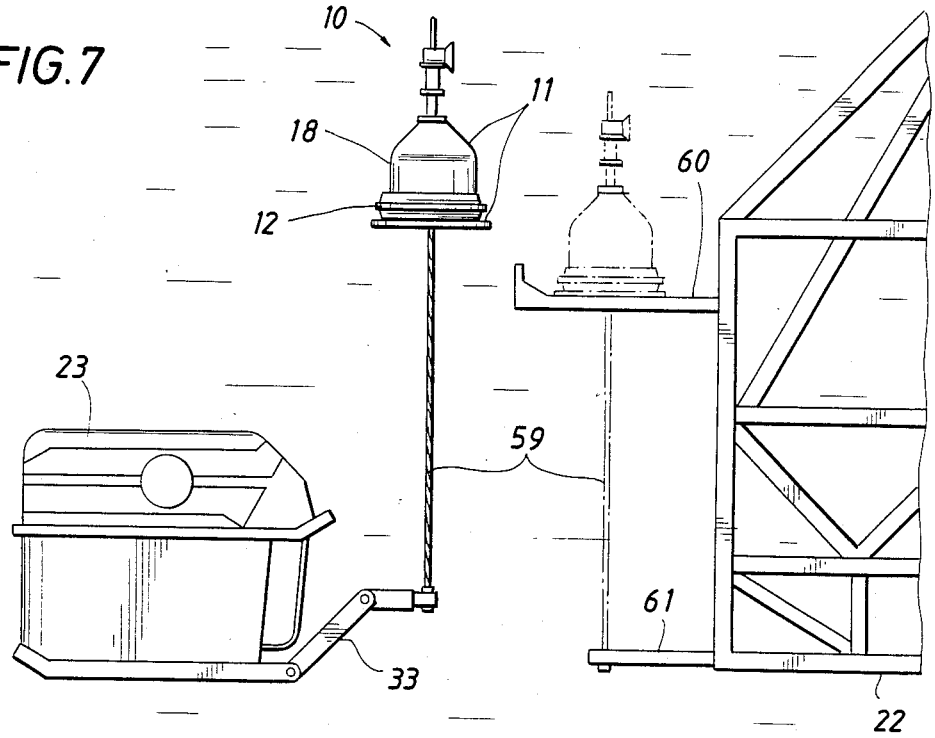
FIG. 7 is a schematic representation of the tool with buoyant material illustrated as being incorporated in the central body.

As shown in FIG. 7 in an alternative embodiment buoyant material means 18 such as buoyant foam material well known to the art have been incorporated within the centralizer body means 11 of the gasket installation tool 10. Sufficient buoyant material means 18 have been added to render the installation tool 10 positively buoyant even when carrying the ring gasket 12. The manipulator arm 33 of the underwater vehicle 23 is attached to the lower end of the cable 59 depending downwardly from the installation tool 10. In this embodiment the tool 10 may float above the underwater vehicle 23 a sufficient distance to allow the tool 10 to settle upon an upper retainer ledge 60 attached to cage portion 22, at the same time that the lower end of the cable 59 is secured to a lower retainer ledge 61. Secured in this manner the installation tool 10 will remain on the upper ledge 60 when the cage portion 22 is brought above the surface 35 of the body of water 36.

The length of the cable 59 will be a selective distance sufficient to allow the centralizer body means 11 of the tool 10 to float upwards through the wellhead connector 47 to the ring gasket retainer assembly 45 (FIG. 6). Due to the positive buoyancy of the gasket installation tool 10 a cable portion 24 need not be attached to the upper end of the tool 10 in order to assist the tool 10 to its proper location between elements of the ring gasket retainer assembly 45 (FIG. 6). Fluid passages (not shown) may be defined through the buoyant material means 18 to allow water to sluice through the tool 10.

Figure 8:
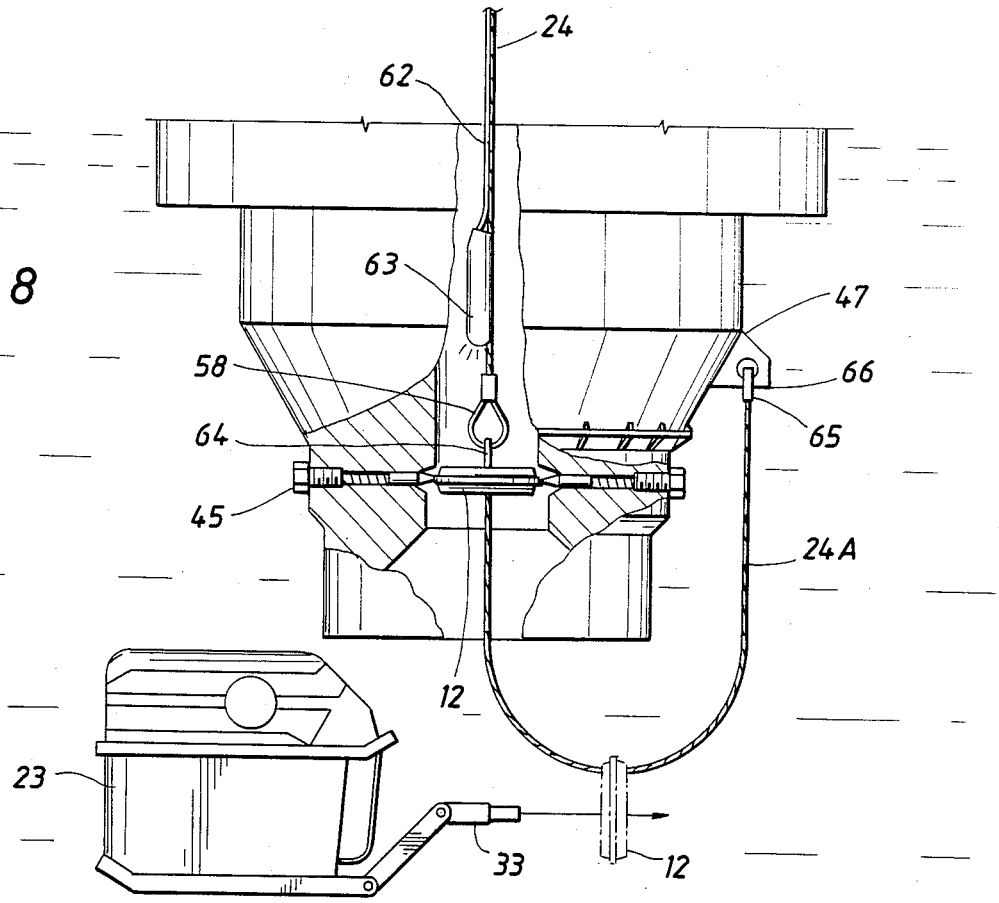
FIG. 8 is a schematic representation of a ring gasket retrieval method.

A means of retrieving a previous installed ring gasket 12 to the surface 35 of a body of water 36 is shown in FIG. 8. A cable portion 24, 24A of the subsea transportation assembly 17 is shown extended downwardly through the wellhead connector 47. The cable portion 24 also includes a TV signal transmission cable 62 attached to a TV camera 63. A ring 58 is located beneath the TV camera 63 with a hook 64 attached to the ring 58. The cable portion 24A extends further beyond the hook 64 eventually ending in another hook 65 attached to pad eye 66 which is shown connected to a portion of the wellhead connector 47. The cable portion 24A extends downwardly through the inner diameter of the ring gasket 12 held by the retainer assembly 45.

The retainer assembly 45 is then actuated to release the ring gasket 12 from the wellhead connector 47. The ring gasket 12 falls to the lower portion of the cable portion 24A. In this position the manipulator arm 33 of the underwater vehicle 23 may grip the ring gasket 12 in order to return the gasket 12 to the surface 35. During its return to the surface 35 the underwater vehicle 23 will disconnect hook 65 from pad eye 66 in order to allow the cable portion 24A to fall through the ring gasket 12. The cable portion 24, 24A may then be returned upwardly through the wellhead connector 47 or the portion of the cable portion 24A from between hook 64 and hook 65 may be returned with the underwater vehicle 23 to the surface 35. The TV camera 63 may be used to properly assist in positioning the underwater vehicle 23 during these operations, if needed.

In operation, the ring gasket 12 is mounted on the ring gasket installation tool 10 above the surface 35 of the body of water 36. The tool 10 is attached to a portion of the subsea transportation assembly 17. The tool 10 may be attached to the television-equipped underwater vehicle 23 which is equipped with thrusters adapted to be powered and operated, from the surface vessel 34. Operations in the underwater environment may therefore be observed visually on the surface vessel 34. To allow selective control of the operations from the surface location, the vehicle 23 is connected by a power and signal transmitting cable 42 to the vessel 34. The tool 10 may also be connected to the cage portion 22 of the subsea transportation assembly 17, during a portion of the tools' 10 journey to the desired underwater location.

If desired, prior to mounting the ring gasket 12 on the installation tool 10, a rod 44 may be attached to the lower portion of the tool 10 with the lower end of the rod 44 subsequently being carried or attached to one portion of the subsea transportation assembly 17, such as the cage portion 22 or the underwater vehicle portion 23.

Also prior to lowering the ring gasket installation tool 10 downwardly through the body of water 36, the tool 10 may be provided with buoyant material means 18 sufficient to maintain the tool 10 positively buoyant when carrying the ring gasket 12.

If the tool 10 is positively buoyant after the tool 10 has carried the gasket 12 to the wellhead connector 47, the tool 10 may be lowered from the opening 50 defined through the wellhead connector 47 by lowering the underwater vehicle 23, or by lowering the manipulator arm 33 of the underwater vehicle 23.

In any event, after the ring gasket 12 is mounted on the tool 10 and the tool 10 is then attached to a portion of the subsea transportation assembly 17, the subsea transportation assembly 17, ring gasket 12, and tool 10 are then lowered downwardly through the water 36 to a location adjacent the pipe assembly 48. In this location at least a portion of the subsea transportation assembly 17, comprising the self-propelled underwater vehicle 23 carrying the ring gasket 12, may transport the ring gasket 12 and installation tool 10 from a location adjacent the pipe assembly 48 to a position substantially centrally beneath the opening 50 defined upwardly through the wellhead connector 47. Depending upon the various combinations possible in the construction and operation of the subsea transportation assembly 17, the ring installation tool 10 may be disconnected from one portion of the transportation assembly 17 and connected to another portion during or after lowering the sub-sea transportation assembly 17, ring gasket 12, and ring gasket installation tool 10 downwardly through the water 36 to the location adjacent the pipe assembly 48.

The ring gasket 12 and gasket installation tool 10 are then inserted upwardly into the opening 50 defined through the wellhead connector 47 and into engagement with the wellhead connector 47. At this point the ring gasket retainer assembly 45 may be actuated to connect the ring gasket 12 to the wellhead connector 47. Prior to insertion of the ring gasket 12 and gasket installation tool 10 upwardly into the opening 50, a previously installed ring gasket 12 may be removed by use of the subsea transportation assembly 17 and tool 10A (FIG. 2). The previously-installed ring gasket 12 may be disconnected from the wellhead connector 47 and the ring gasket 12 caught upon a suitable portion of the subsea transportation assembly 17. For example, the ring gasket 12 may be allowed to fall upon the upper surface of the underwater vehicle 23, or a spare gasket installation tool 10A (FIG. 2) not carrying a ring gasket 12 may be utilized to catch the ring gasket 12, as it falls from the retainer assembly 45. Alternatively, the previously installed ring gasket 12 may be disconnected from the wellhead connector 47 and the gasket 12 allowed to fall to the bottom of the water 67.

In one form of the invention, the connection of the ring gasket 12 to the wellhead connector 47 may be accomplished in the following manner. A cable portion 24 of the subsea transportation assembly 17 may be lowered through the pipe assembly 48 from the vessel 34. This cable portion 24 is adapted to be powered and operated from the surface 35 location to raise upwardly through wellhead openings 50, 50A. The ring gasket installation tool 10 can be provided with cable attachment means 16 attached to the installation tool 10 in order to connect the tool 10 to the cable portion 24. Once the tool 10 is connected to the cable portion 24, raising the cable 24 upwardly through opening 50, 50A will correspondingly cause the tool 10 to rise upwardly through the opening 10 and eventually the ring gasket 12 will contact the ring gasket retainer assembly 45 carried within the wellhead opening 50. The cable portion 24 may also be lowered downwardly through the wellhead connector 47 in order to lower the tool 10 downwardly through the wellhead opening 50 by operation of the cable portion 24.

Once the ring gasket 12 is connected to the wellhead connector 47 the ring gasket installation tool 10 may move downwardly out of the wellhead connector 47 and to one side. The entire subsea transportation assembly 17 at this point may be returned to the surface 35 of the body of water 36.

Many other variations and modifications may be made in the apparatus and techniques hereinbefore described, both by those having experience in this technology, without departing from the concept of the present invention. Accordingly, it should be clearly understood that the apparatus and methods depicted in the accompanying drawings and foregoing description are illustrative only and are not intended as limitations on the scope of the invention.

We claim as our invention:

1. Method of attaching underwater a ring gasket to a ring gasket retainer assembly located in a wellhead connector, said method employing the use of an underwater vehicle equipped with thrusters, said underwater vehicle forming at least a portion of a subsea ring gasket transportation assembly, said method comprising:

mounting said ring gasket on a ring gasket installation tool, said gasket installation tool attached to at least a portion of said subsea transportation assembly, lowering said subsea transportation assembly, ring gasket, and ring gasket installation tool downwardly through the water together to a location adjacent said wellhead connector, transporting said ring gasket, and said installation tool carrying said ring gasket, from said location adjacent said wellhead connector to a position substantially centrally beneath an opening defined upwardly through said wellhead connector, inserting said ring gasket and gasket installation tool upwardly into said opening defined through said wellhead connector into engagement therewith, and connecting said ring gasket to said wellhead connector.

2. The method of claim 1 including, after lowering said subsea transportation assembly, ring gasket, and ring gasket installation tool downwardly through the water together to a location adjacent said wellhead connector, transporting said ring gasket, installation tool, and at least a portion of said subsea transportation assembly comprising said self-propelled underwater vehicle carrying said ring gasket, from said location adjacent said wellhead connector to a position substantially centrally beneath said opening defined upwardly through said wellhead connector.

3. The method of claim 1 including, after lowering said subsea transportation assembly, ring gasket, and ring gasket installation tool downwardly through the water together to a location adjacent said wellhead connector, disconnecting said ring installation tool from one portion of said subsea transportation assembly and connecting said ring installation tool to another portion of said subsea transportation assembly.

4. The method of claim 1 including, prior to mounting said ring gasket on said ring gasket installation tool, providing a rod, installing said rod between said ring gasket installation tool and at least a portion of said subsea transportation assembly.

5. The method of claim 1 including, prior to connecting said ring gasket to said wellhead connector, providing said ring gasket installation tool with cable attachment means, providing a cable depending downwardly from said opening defined through said wellhead connector, said cable adapted to be powered and operated from a surface location to raise upwardly through said opening, attaching said installation tool to said cable, and raising said tool upwardly through said wellhead opening by operation of said cable.

6. The method of claim 5 including, after connecting said ring gasket to said wellhead connector, providing said cable powered and operated from a surface location to lower through said wellhead opening, and lowering said tool downwardly through said wellhead opening by operation of said cable.

7. The method of claim 1 including, prior to lowering said ring gasket installation tool downwardly through said water, providing said tool with buoyant material means sufficient to maintain said tool positively buoyant when carrying said ring gasket.

8. The method of claim 7 including, after connecting said ring gasket to said wellhead connector, lowering said tool from said opening defined through said wellhead connector by lowering said portion of said subsea transportation assembly attached to said tool.

9. The method of claim 1 including, prior to inserting said ring gasket and gasket installation tool upwardly into said opening defined through said wellhead connector into engagement therewith, removing underwater a previously installed ring gasket.

10. The method of claim 9 including the step of, disconnecting said previously installed ring gasket from said wellhead connector, and allowing said gasket to fall to the bottom of said water.

11. The method of claim 9 including the steps of, disconnecting said ring gasket from said wellhead connector, and catching said ring gasket on a suitable portion of said subsea transportation assembly.

12. The method of claim 1 including, after inserting said ring gasket and gasket installation tool upwardly into said opening defined through said wellhead connector into engagement therewith, actuating said ring gasket retainer assembly to connect said ring gasket to said wellhead connector.

13. Ring gasket installation apparatus adapted to be secured to an underwater vehicle forming at least a portion of a subsea ring gasket transportation assembly for moving a ring gasket having a circular inner diameter to a ring gasket retainer assembly located within an opening defined through a wellhead connector located at the lower end of a pipe assembly, said apparatus comprising:

centralizer body means having an upper centralizer portion and lower shoulder portion means for carrying a ring gasket thereon, said centralizer portion having a central vertical axis and having an outer diameter less than the inner diameter of said ring gasket, to prevent said ring gasket from substantial lateral movement toward and away from said central vertical axis, said shoulder portion means extending outwardly to an outer diameter greater than the inner diameter of said ring gasket, to form a barrier to prevent downward vertical movement of said ring gasket below said shoulder portion means, said shoulder portion means outer diameter being less than the diameter of said opening defined through said wellhead connector, and ring gasket transportation assembly attachment means connected to said centralizer body means, to attach said centralizer body means to at least one portion of said subsea transportation assembly.

14. The apparatus of claim 13 wherein a portion of said centralizer body means comprises;

buoyant material means, to maintain said body means positively buoyant when carrying said ring gasket.

15. The apparatus of claim 14 wherein said transportation assembly attachment means comprises;

a cable attached at one end to a lower portion of said centralizer body means, extending downwardly a selective distance and operatively engageable with a manipulator arm carried by said underwater vehicle, said selective distance sufficient to allow said centralizer body means to float upwards through said wellhead connector to said ring gasket retainer assembly.

16. The apparatus of claim 13 wherein said transportation assembly attachment means comprises;

a hook fixedly connected to an upper portion of said centralizer body means connectable to said transportation assembly, and a rod connected to a lower portion of said centralizer body means extending downwardly a selective distance and operatively engageable with a manipulator arm carried by said underwater vehicle, said selective distance sufficient to allow insertion of said ring gasket upward through said opening defined through said wellhead connector to said ring gasket retainer assembly.

17. The apparatus of claim 13 wherein said transportation assembly attachment means comprises;

a cable attached at one end to a lower portion of said centralizer body means, extendingly downwardly and operatively engageable with a manipulator arm carried by said underwater vehicle, and a hook fixedly connected to an upper portion of said centralizer body means connectable to a cable forming a portion of said transportation assembly, said transportation assembly cable extending downwardly through said opening defined through said wellhead connector and operable from a surface location.

* * * * *